United States Patent [19]

Shabram, Sr. et al.

[11] Patent Number: 4,558,806

[45] Date of Patent: Dec. 17, 1985

[54] CONDIMENT CAP

[76] Inventors: Lyle F. Shabram, Sr., P.O. Box 5537, Carmel, Calif. 93921; Lyle F. Shabram, Jr., 1215 Surf Ave., Pacific Grove, Calif. 93950

[21] Appl. No.: 572,377

[22] Filed: Jan. 20, 1984

[51] Int. Cl.[4] ..... B67D 3/00

[52] U.S. Cl. ..... 222/556; 222/498

[58] Field of Search ..... 222/472, 480, 498, 508, 222/517, 533–536, 545, 556, 558, 565

[56] References Cited

U.S. PATENT DOCUMENTS

| | | | |
|---|---|---|---|
| 1,173,546 | 2/1916 | Baron | 222/472 |
| 3,140,019 | 7/1964 | Barr | 222/556 X |
| 3,201,011 | 8/1965 | Brocken | 222/517 X |
| 3,217,949 | 11/1965 | Davis | 222/545 X |
| 3,300,106 | 1/1967 | Chmela | 222/556 X |
| 3,303,971 | 2/1967 | Stevens, Jr. | 222/534 X |
| 3,515,314 | 6/1970 | Waterman | 222/556 X |
| 3,563,426 | 2/1971 | Bartilson | 222/556 |
| 3,853,250 | 12/1974 | Alpern | 222/545 X |
| 4,223,814 | 9/1980 | Sneider | 222/565 |

*Primary Examiner*—Joseph J. Rolla
*Assistant Examiner*—Kevin P. Shaver
*Attorney, Agent, or Firm*—Hamrick, Hoffman, Guillot & Kazubowski

[57] ABSTRACT

A closure cap for a container of granular solid contents. The cap has a body and a coverflap. The body has pouring apertures, hinge post receivers and a relief. The coverflap has hinge posts that fit into the hinge post receivers, sealing protrusions that can seal the pouring apertures and a depressable end. The depressable end can be depressed into the relief on the body, allowing lever action. The sealing protrusions and the pouring apertures can be disengaged by application of pressure to the depressable end, and the contents can then be removed from the container.

8 Claims, 6 Drawing Figures

CONDIMENT CAP

BACKGROUND OF THE INVENTION

1. Field of the Invention

This invention relates to caps having resealable pour apertures, particularly, to caps having lever action lids for unsealing pour apertures by finger pressure.

2. Description of The Prior Art

Spice cans and the like, usually have a dispenser type cover that allows unlimited amount of granular contents to be shaken from the can. One problem with containers for condiments dry spice and the like is that the cap must be airtight to prevent loss of aroma and flavor. Conventional thin airtight closure covers are difficult to lift or open and frequenty require the user to use both hands.

An example of one type of cap is to be found in U.S. Pat. No. 4,223,814, issued to Sneider. This patent discloses a cap for dispensing granular solids having an articulated cover piece with a plurality of plugs to secure the cap and prevent loss of aroma and flavor. This Patent does not teach a lever type arrangement.

Another type of cap is disclosed in U.S. Pat. No. 3,853,250 issued to Alpern, which discloses a two-piece cap with a body and a cover. The cover is attached to the body by lugs that are resilient enough to spring the cover securely over the body when a force is removed from the cover plate. The arrangement of the elements is such that the users finger can force open the cover, which snaps shuts by the force of the resilient lugs when the force of that finger is removed.

U.S. Pat. No. 3,217,949 discloses the dispenser having two articulated portions of a single molded cap piece. The first portion of the plurality of small openings suitable for dispensing small quantities of contents and a second has one larger opening suitable for dispensing bulk quantities of the product.

Other patents of interest include U.S. Pat. No. 3,516,581 which discloses a toggle type closure; U.S. Pat. No. 3,303,971 which discloses a hinge dispenser spout; U.S. Pat. No. 3,300,106 which discloses a pouring spout made from one molded piece of plastic; U.S. Pat. No. 2,635,792 which discloses a dispenser lid; and U.S. Pat. No. 1,657,661 which discloses a spring-loaded dispenser lid. Any of the caps made from the disclosures cited above can be made of a thermal plastic.

SUMMARY OF THE PRESENT INVENTION

An object of this invention is to provide a closure for a container of granular product that can be readily manufactured by present plastic molding technology.

Another object of this invention is to provide an easy to use and secure closure that is workable by finger pressure from a finger of the hand holding the container.

Yet another object of this invention is to provide an easily manufactured closure of two parts that requires no bonding or fasteners.

Still another object of this invention is to provide a novel closure of similar size and design as conventional caps for containers of granular solids.

The present invention comprises a closure cap for a container for solid granular contents. The cap has a coverflap portion and a body portion. The cover flap has hinge posts that fit into recesses in the body portion allowing the coverflap to pivot in response to finger pressure. The body has a plurality of pouring apertures to allow passages of granular contents that are resealable. The coverflap has sealing protrusions that securely fit into each pouring aperture. The body has a relief cavity to receive the depressable portion of the lid to allow it to pivot.

An advantage of the present invention is that an operator can open the pouring apertures with the pressure from one finger of the hand holding the condiment bottle.

Another advantage of the present invention is that the closure disclosed can be readily made from known materials using conventional technology.

Yet another advantage of the present invention is that it eliminates the need for separate jar fitments for controlled dispensing of contents, whereas pouring apertures are included in the cap and the cap does not have to be removed.

These and other objects and advantages will become apparent to those skilled in the art by referring to the below referenced drawings and the detailed description.

IN THE DRAWING

DETAILED DESCRIPTION OF THE PREFERRED EMBODIMENT

Figure 1:
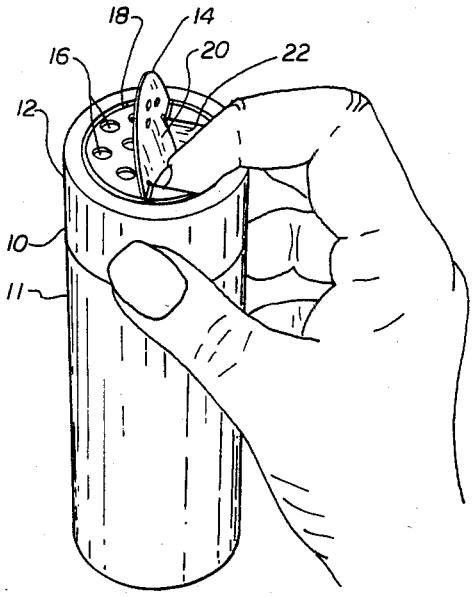
FIG. 1 shows an the cap of the present invention mounted on a condiment bottle.

Referring to FIG. 1, a condiment container cap 10 is shown with its coverflap 14 in an open position. The cap consists of a molded body 12 and a molded cover flap 14. The body has a plurality of apertures 16 for allowing passage of granular condiment. The lid has a plurality of sealing protrusions 18. There is one sealing protrusion 18 for each sealing aperture 16. The number and the size of protrusions and apertures depend on granular size of condiment. The coverflap has a depressable end 20 that is depressed within a coverflap relief cavity 22 in the body portion of the cap. When the cap is attached to a bottle 11 filled with granular contents, the bottle can be held by one hand and a finger of the holding hand can depress the depressable portion, thereby opening the plurality of apertures in the body. The granular contents can then be dispensed by shaking the bottle.

Figure 2:
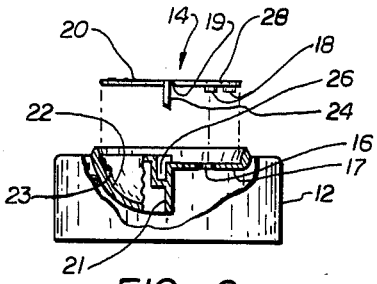
FIG. 2 shows a partially cut-away side view along the line 2—2 in FIG. 4 of the present invention.

Referring to FIG. 2, the coverflap 14 of the cap has two hinge posts 24 extending at a 90 degree angle to the coverflap surface to be received in a pair of hinge post cavities 26 formed in the cap body 12. The coverflap has a sealing end 28 and a depressable end 20.

When in place in the cap body 12, the hinge posts 24 are received in the hinge post receiving cavities 26. The pouring apertures 16 are each sealed by one of the sealing protrusions 18. Finger pressure, preferably from a finger of the hand holding the bottle, depresses the depressable end 20 into a relief cavity 22 thereby allowing the pouring protrusions to disengage from the pouring protrusions to disengage from the pouring apertures. Granular condiment can then pour freely from the opened apertures.

A coverflap relief ridge 17 on the top surface of the body 12 allows the coverflap 14 to be flush with the top surface of the body when the coverflap is closed.

The junction of the hinge posts 24 to the coverflap 14 must be a flexible "living hinge" 19, since the coverflap 14 is to be rotated while the hinge posts are stationary relative to the cap body 12. The hinge posts 24 are thus joined to the coverflap 14 by strips 19 of substantially reduced cross-sectional thickness integrally molded at the junction of the hinge posts 24 and the moveable coverflap 14 per se. These thinned strips define a hinge line 25 about which the coverflap 14 may be rotated relative to the posts 24. The coverflap 14, and preferably the entire cap device, will be molded from polypropylene.

Figure 3:
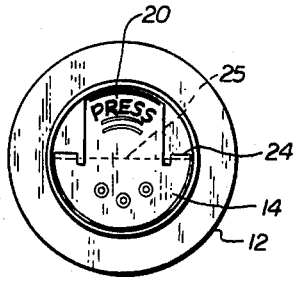
FIG. 3 shows a top view of the present invention.

In FIG. 3, a cap device of the present invention is shown with the coverflap 14 in place and closed. The two hinge posts 24 on the outermost portions of the hinge line 25 fit into recesses 26 in the top of the body 12. Finger pressure applied to the depressable end 20 is enough to force the sealing protrusions from the sealing apertures in the body of the cap, thereby allowing granular condiment to be shaken from the bottle.

Figure 4:
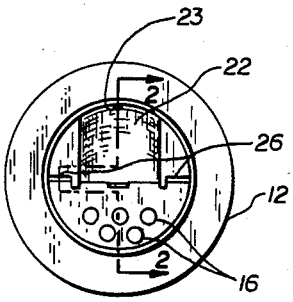
FIG. 4 shows a top view with the coverflap removed of the present invention.

Referring to FIG. 4, the top side of body 12 is shown to have pouring apertures 16 and a relief cavity 22 for receiving the depressable portion of the coverflap. The inner walls of the relief cavity 22 provide support and strength to the cap construction while the upper extremity of the wall 21 also defines a pivot line 27 for supporting the pivoting action of the coverflap. Two rectangular recesses 26 that are of the correct dimensions to receive the hinge posts 24 of a coverflap are disposed on the sides of relief cavity 22. The depressable end of the coverflap extends over the relief cavity of the cap body.

Comparing FIG. 4 with FIGS. 2 and 3, it will be observed that the hinge line 25 defined by the hinges 19 lies along a line parallel to and immediately above the pivot line 27 formed at the upper edge of wall 21 and both lie along a diameter of the circular ridge 17. The vertical spacing between the hinge line 25 and the pivot line 27 is approximately equal to the thickness of coverflap 14. This is an important feature of the present invention in that it allows minimum clearance between the opposing surfaces of coverflap 14 and cap body 12 with each such surface being arcuate in configuration. Moreover, it insures that no substantial bending of any coverflap component other than the hinges is caused during opening and closing operation. Since the hinge is quite thin and has very little elastic "memory", once the lid is opened it will tend to stay in the open position until a closing force is applied.

Figure 5:
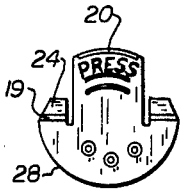
FIG. 5 shows a top view of the coverflap of the present invention.
Figure 6:
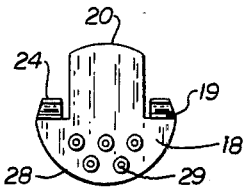
FIG. 6 shows the bottom view of the coverflap portion of the present invention.

Referring to FIGS. 5 and 6, which are respectively top and bottom views of coverflap 14, it will be further noted that the coverflap has a pivotable closure portion that includes the sealing end 28 and the depressable end 20, and two hinge posts 24. A plurality of sealing protrusions 18 are provided which, as indicated above, firmly seal with the apertures 16 (FIG. 4) in the cap body. The hinge posts 24 are flexibly attached to the moveable portion of the coverflap by the integrally formed hinges 19. When the cap is assembled, the relief cavity 22 provides a relief for the pivoting action of the coverflap without further exposing the contents of the container. Preferably, the cavity 22 fits snugly with the opposing edges of the depressable portion of the coverflap in all possible depressed positions. The contact between the edges of the coverflap and the cavity forming walls 22 forms enough friction contact to maintain the open configuration of the top of the body portion relative to the coverflap without continued pressure from the users finger. The coverflap 14 then remains in any of its possible open positions.

The coverflap 14 may be pivoted from a fully closed position to a fully opened position. In the fully opened position, the coverflap and the top surface of the body form approximately a 90 degree angle. When the coverflap 14 is in the closed position, it is preferable that its top surface be flush with the top surface of the body of the cap. Preferably, a coverflap recess forming ridge 17 formed in the cap body accommodates the coverflap 14 when in the closed position making it flush with the top surface of the cap.

The sealing protrusions 18 should provide a tight closure with the apertures 16, preventing a loss of contents and their aroma. The closure should be a positive fit so that the lid remains securely closed. An additional detent 23 is preferably formed on the inside of the periphery of the general relief surface 22 just below the level of the bottom surface of coverflap 14 when it is in its closed position to prevent the lid from unintentionally opening once it is snapped closed. It is also preferred that the sealing protrusions be hollowed on their bottom surfaces as shown at 29 (FIG. 6) thereby imparting flexibility to them to provide a tight seal when they are engaged with the sealing apertures.

In a preferred embodiment, the coverflap is essentially circular in shape having a smaller diameter than the cap. Two cut-away sections allow the hinge posts to be located on the pivot line of the coverflap. In a conventional lid, the entire pivot line would be a flexible hinge that extends across the lid. In contrast, in this invention, two hinge posts are located on the two outermost extremities of the pivot line, allowing the depressable end of the coverflap to extend past the pivot line. This geometry, with the inner wall of relief cavity supporting the pivot, permits the lever action of the present invention. Since the coverflap pivots by the simple connecting hinge posts, there is no need for the complicated mold assemblies used to mold conventional lift flap closures.

When in use, the body may have threads allowing it to be attached to conventional threaded glass condiment bottles. Other methods of connecting the cap to a bottle may also be used to secure the cap to a bottle.

While the invention has been particularly shown and described with reference to a certain embodiment, it will be understood by those skilled in the art that various alterations and modifications in form and detail may be made therein. Accordingly, it is intended that the following claims cover all such alterations and modifications as fall within the true spirit and scope of the invention.

What is claimed is:

1. A condiment container cap comprising:

a cap body suitable for attachment to a condiment container and having a top surface, including, a plurality of pouring apertures formed in an array in said top surface on a first side of a pivot line extending thereacross, two hinge post receiving cavities formed in said top surface and disposed in spaced apart relationship along said pivot line, and a relief cavity formed in the top of said body on a second side of said pivot line, said pivot line being formed by the intersection of said top surface with the upper edge of a wall of said relief cavity; and means forming a coverflap including a substantially rigid planar closure having a depressable end portion and a sealing end portion divided by a hinge line, the sealing end portion having a plurality of sealing protrusions extending downwardly therefrom and disposed in an array corresponding to that of said plurality of pouring apertures, and two hinge posts extending downwardly therefrom and located in spaced apart relationship along said hinge line, said hinge posts being formed integrally with said sealing end portion and attached thereto by living hinges formed of thinned elongated portions of said coverflap of thickness substantially less than the thickness of said hinge posts, said elongated portions being disposed in spaced apart relationship with their longitudinal axes being colinear and defining said hinge line, said hinge posts being disposed in said hinge post receiving cavities such that said hinge line lies directly above said pivot line thereby permitting said coverflap to engage said upper edge and be rotated about said pivot line between a closed position and an open position, said sealing protrusions being disposed in sealing engagement with said pouring apertures when said coverflap is in said closed position and being withdrawn from said sealing engagement when said depressable end is rotated into said relief cavity.

2. The condiment container cap of claim 1 wherein said pouring apertures are circular openings of diameter large enoough to allow ready passage of of dry granular condiments.

3. The condiment container cap of claim 1 wherein said coverflap and said body are adapted to sealingly engage each other such that said cap provides a substantially air tight seal when said coverflap is in said closed position.

4. The condiment container cap of claim 1 wherein said cap body has walls forming said relief cavity, the walls of said body and the perimeter edges of said depressable end frictionally engage each other during motion between open and closed positions of said coverflap thereby causing said coverflap to maintain a selected angular relationship with the cap body when said cap is in said open position.

5. The condiment container cap of claim 1 wherein said coverflap has two cut-away sections crossing said hinge line and separating the upper end portions of said hinge posts from said depressible end portion.

6. The condiment cap of claim 1 wherein said coverflap is secured in said closed position by a detent.

7. The condiment cap of claim 6 wherein said body has a coverflap recess that said sealing end portion of said coverflap rests within when said coverflap is in said closed position.

8. The condiment container cap of claim 6 wherein said detent is disposed slightly beneath the closed position of the bottom surface of said depressible end portion and protrudes from a wall of said relief cavity.

* * * * *